US005615732A

United States Patent [19]

Brophy et al.

[11] Patent Number: 5,615,732

[45] Date of Patent: Apr. 1, 1997

[54] AIR PREHEATER WITH SEMI-MODULAR ROTOR CONSTRUCTION

[75] Inventors: Mark E. Brophy, Wellsville; William C. Cox, Hornell, both of N.Y.; Harlan E. Finnemore, Pocatello, Id.; Glenn D. Mattison, Wellsville, N.Y.; Rex R. Snider, Corfu, N.Y.; Michael W. Wonderling, Scio, N.Y.

[73] Assignee: ABB Preheater, Inc., Wellsville, N.Y.

[21] Appl. No.: 604,914

[22] Filed: Feb. 22, 1996

[51] Int. Cl.[6] ..... F23L 15/02

[52] U.S. Cl. ..... 165/8; 165/10; 29/890.034

[58] Field of Search ..... 165/8, 10, 6; 29/890.034

[56] References Cited

U.S. PATENT DOCUMENTS

| | | | |
|---|---|---|---|
| 3,267,562 | 8/1966 | Chiang et al. | 165/8 |
| 3,830,287 | 8/1974 | Eisenstein | 165/10 |
| 3,906,606 | 9/1975 | Mahoney | 29/890.034 |
| 3,998,266 | 12/1976 | Finnemore | 165/8 |
| 4,063,587 | 12/1977 | Stockman | 165/8 |

*Primary Examiner*—John Rivell
*Assistant Examiner*—Christopher Atkinson
*Attorney, Agent, or Firm*—Chilton, Alix & Van Kirk

[57] ABSTRACT

The rotor for a rotary regenerative air preheater is fabricated from a combination of shop assembled rotor sector modules and field assembled components so as to eliminate the double plate diaphragms of conventional modular rotors. The shop assembled modules comprise one or more sectors and the field assembled components fit between the spaced shop assembled modules spaced around the rotor hub. The support gratings between the diaphragm plates support modular heat exchange baskets which are loaded into the rotor radially from the periphery.

4 Claims, 6 Drawing Sheets

AIR PREHEATER WITH SEMI-MODULAR ROTOR CONSTRUCTION

BACKGROUND OF THE INVENTION

The present invention relates to rotary regenerative heat exchangers generally used as air preheaters and more specifically to an improved rotor construction which combines the advantages of both modular and non-modular construction methods.

A rotary regenerative heat exchanger is employed to transfer heat from one hot gas stream, such as a hot flue gas stream, to another cold gas stream, such as combustion air. The rotor contains a mass of heat absorbent material which first rotates through a passageway for the hot gas stream where heat is absorbed by the heat absorbent material. As the rotor continues to turn, the heated absorbent material enters the passageway for the cold gas stream where the heat is transferred from the absorbent material to the cold gas stream.

In a typical rotary heat exchanger, such a rotary regenerative air preheater, the cylindrical rotor is disposed on a vertical central rotor post and divided into a plurality of sector-shaped compartments by a plurality of radial partitions, referred to as diaphragms, extending from the rotor post to the outer peripheral shell of the rotor. These sector-shaped compartments are loaded with modular heat exchange baskets which contain the mass of heat absorbent material commonly formed of stacked plate-like elements.

The rotors of such heat exchangers are either formed as non-modular, shop assembled rotors or as modular rotors. The non-modular rotors comprise a series of diaphragm plates each attached to the rotor post and extending out to the rotor shell thereby dividing the rotor into sectors. Further, each sector is divided into a number of compartments by stay plates extending between the diaphragms at spaced intervals. The modular heat exchange baskets are then loaded axially into these compartments from the top end (duct end). The non-modular rotors are labor intensive because the majority of the rotor structure is first shop-assembled and then at least partially disassembled for shipment. The result is more total time to manufacture and field install.

Modular rotors are composed of a series of shop-assembled sector modules which are then field-assembled into a complete rotor. Each sector module has a diaphragm plate on each side with these two diaphragms being joined by stay plates. When these modules are assembled into a rotor in the field, the diaphragm plates of adjacent modules are joined together to form a double plated diaphragm. Although the modular rotors require less time to field-install than non-modular rotors, they require twice as many individual diaphragm plates which take up gas flow area and allow less heat transfer area for the same size rotor and post diameter. Also, they are component intensive because of all the parts necessary to pin the adjacent modules to each other at diaphragm locations.

Most modular and non-modular rotor designs contain stay plates as previously described. The stay plates reinforce the rotor structure and support the baskets. Because the baskets are inserted axially and must fit in the stay plate compartments, the baskets must be undersized for easy installation and removal. Undersizing involves providing a gap around the perimeter of each basket. This reduces the free area of the basket available for heat transfer flow and creates flow bypass gaps around the baskets. The result is decreased air preheater efficiency and the selection of larger air preheaters for any particular performance requirements.

SUMMARY OF THE INVENTION

The present invention relates to the structure of the rotor for a rotary regenerative heat exchanger and more specifically the way the rotor is fabricated from a combination of shop assembled sector modules and field assembled components in a way to eliminate the double plate diaphragms of the normal modular rotors and reduce the high cost of the complete shop assembly of normal non-modular rotors. In a preferred embodiment, the shop assembled modules comprise one or two or perhaps more sectors, depending primarily on the rotor size, with the field assembled components fitting between spaced shop assembled modules. The invention further eliminates the stay plates and substitutes support gratings which extend between the diaphragms and form open supports on which the baskets are supported. The baskets are loaded into the sectors radially, instead of axially. This eliminates the need for gaps around the baskets and the undersizing of the baskets. These support gratings are part of the shop assembled modules and also are a part of the field assembled components which actually facilitate the field assembly.

DESCRIPTION OF THE PREFERRED EMBODIMENT

Figure 1:
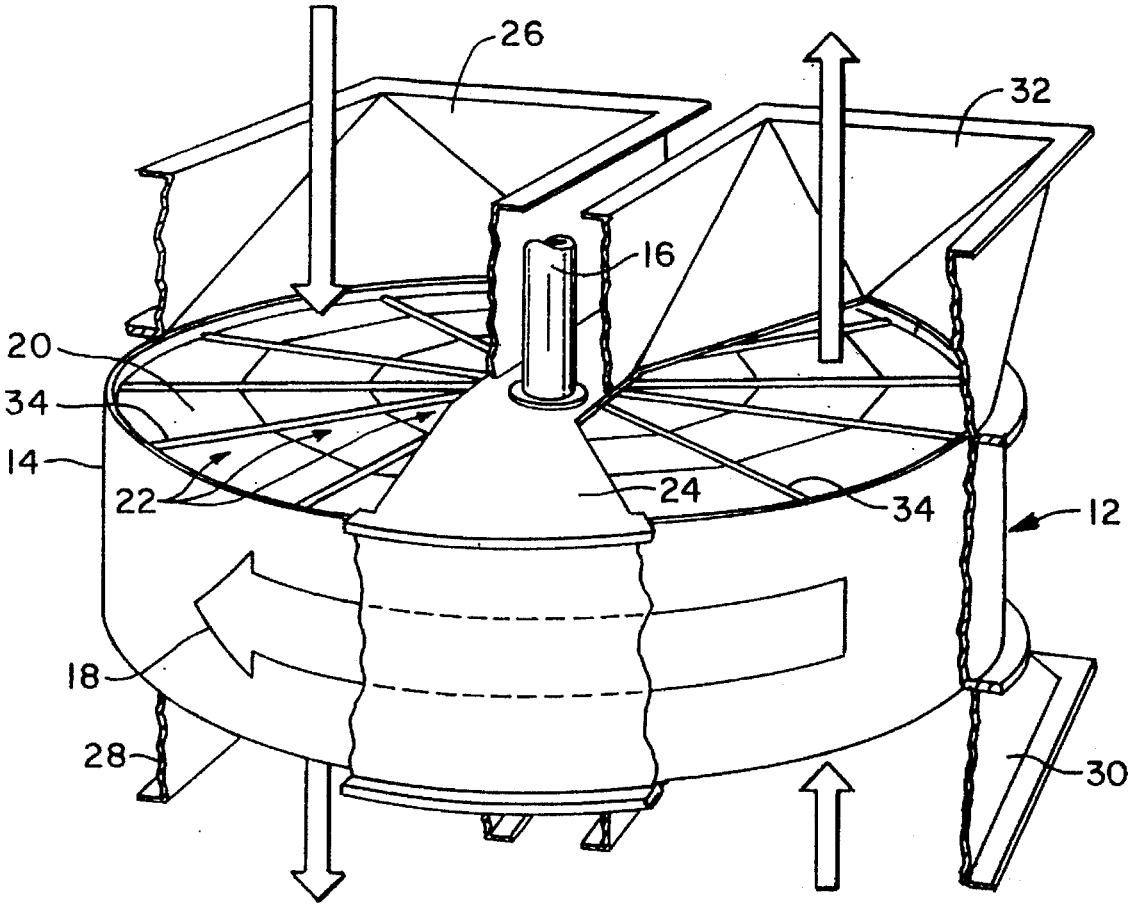
FIG. 1 PRIOR ART
FIG. 1 is a general perspective view of a conventional rotary regenerative air preheater.

FIG. 1 of the drawings is a partially cut-away perspective view of a typical air heater showing a housing 12 in which the rotor 14 is mounted on drive shaft or post 16 for rotation as indicated by the arrow 18. The rotor is composed of a plurality of sectors 20 with each sector containing a number of basket modules 22 and with each sector being defined by the diaphragms 34. The basket modules contain the heat exchange surface. The housing is divided by means of the flow impervious sector plate 24 into a flue gas side and an air side. A corresponding sector plate is also located on the bottom of the unit. The hot flue gases enter the air heater through the gas inlet duct 26, flow through the rotor where heat is transferred to the rotor and then exit through gas outlet duct 28. The countercurrent flowing air enters through air inlet duct 30, flows through the rotor where it picks up heat and then exits through air outlet duct 32.

Figure 2:
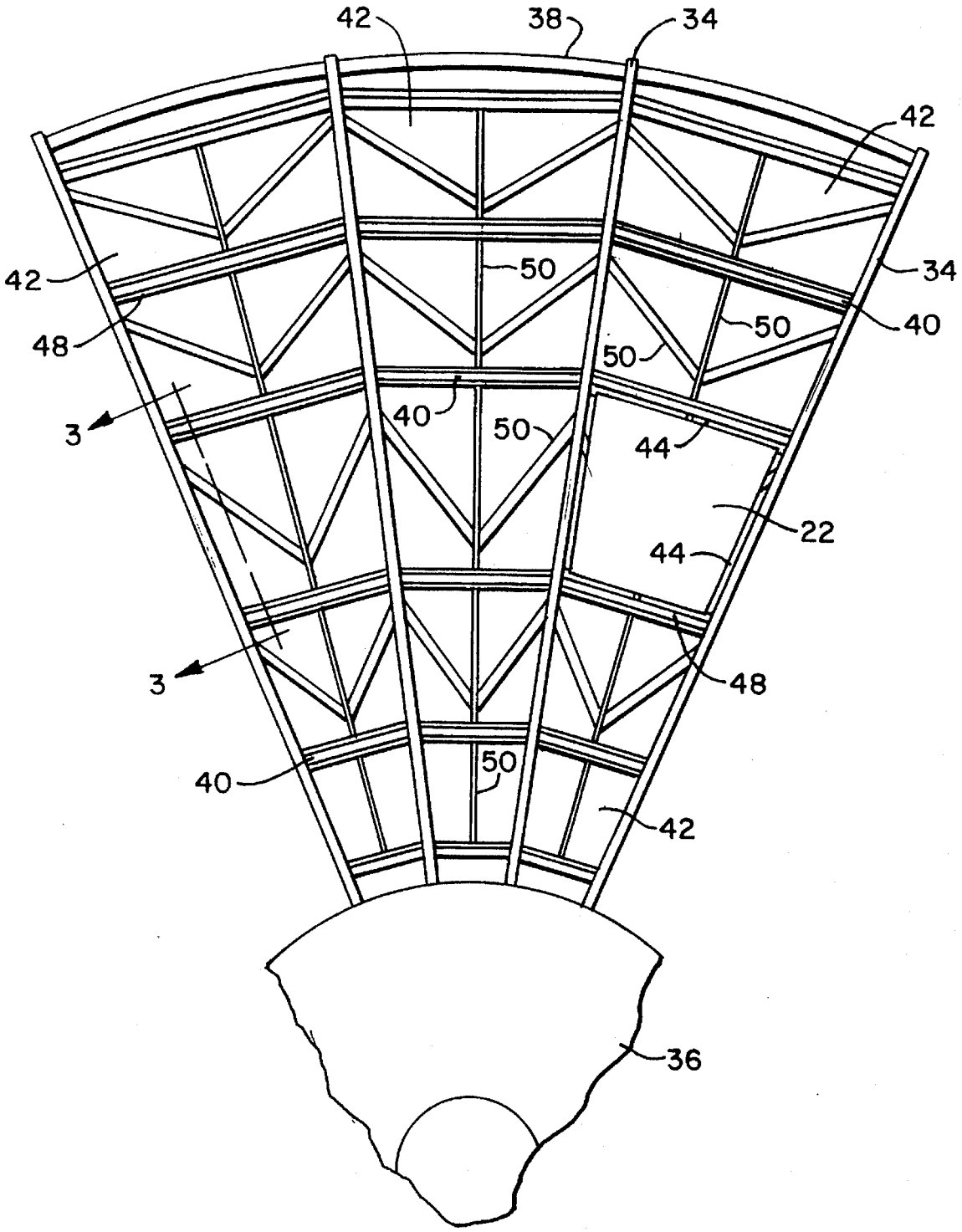
FIG. 2 PRIOR ART
FIG. 2 is a plan view of a non-modular, shop assembled rotor according to the prior art.

Referring now to FIG. 2 which shows a plan view of a portion of a rotor of the prior art shop assembled, non-modular type, the diaphragms 34 extend radially between the central portion or hub 36 of the rotor and the rotor shell 38. Extending between and attached to the diaphragms 34 at spaced intervals are the stay plates 40 thereby forming stay plate compartments 42. The basket modules 22 are stacked into each stay plate compartment. One such basket module 22 is shown in this FIG. 2 while the remaining compartments 42 are empty. Since these basket modules 22 are loaded into and removed from the top, a gap 44 must be provided all around each basket to facilitate that loading and removal. These gaps 44 reduce the size of the baskets which can be accommodated in the rotor thereby decreasing the heat transfer area and thermal efficiency, and creating bypass gaps for the gases.

Figure 3:
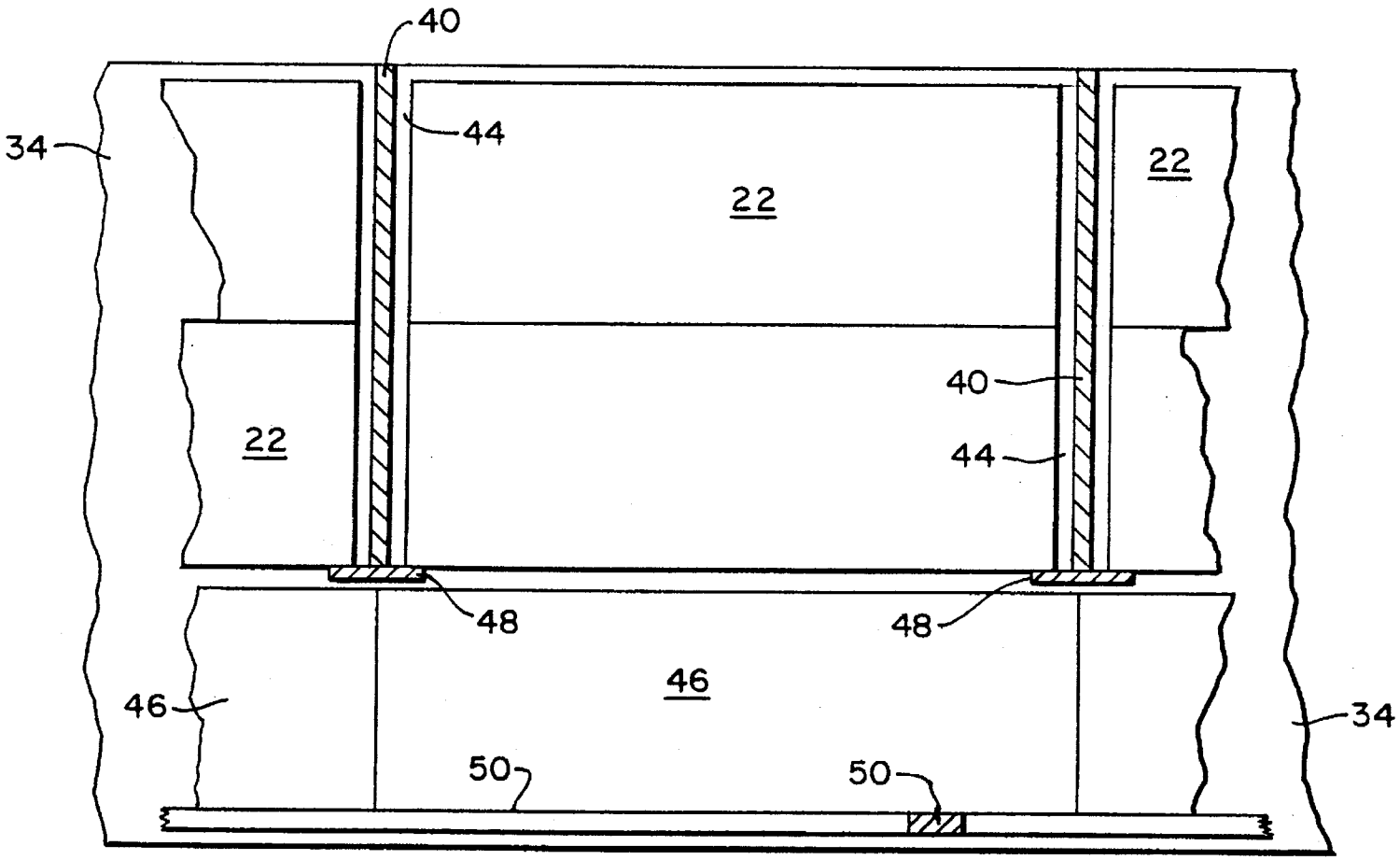
FIG. 3 PRIOR ART
FIG. 3 is a cross section view taken along line 3—3 of FIG. 2 illustrating heat exchange baskets in position in the rotor.

To further understand these prior art non-modular, shop-assembled rotors, reference is made to FIG. 3 which is a view taken along line 3—3 of FIG. 2 except that it does show the modular baskets 22 in position. It also shows the cold end baskets 46 as will be explained. Shown in cross-section are the stay plates 40 which are attached to the diaphragm 34 such as by welding. Attached to the bottom of each stay plate 40 is a basket support member 48 on which the stacked baskets 22 are supported. The basket support members 48 can also be seen in FIG. 2.

Located in the rotor below the arrangement of basket modules 22 and at the cold end of the rotor are a different set of baskets 46 previously mentioned and referred to as cold-end baskets. The cold-end baskets are more subject to the corrosive effects of components of the fuel gas stream which can condense out onto the basket at the cold-end temperatures. In the prior art air preheater depicted, the cold-end baskets 46 are inserted radially from the periphery of the rotor rather than from the top and are supported on a grating or truss structure generally designated 50 and shown also in FIG. 2. Therefore, the stay plates 40 are shorter than the height of the diaphragms as seen in FIG. 3 which also shows the gaps 44. Since the cold-end baskets are more subject to corrosion, and need to be replaced more often, they can be removed radially without the need to remove the hot end baskets.

Figure 4:
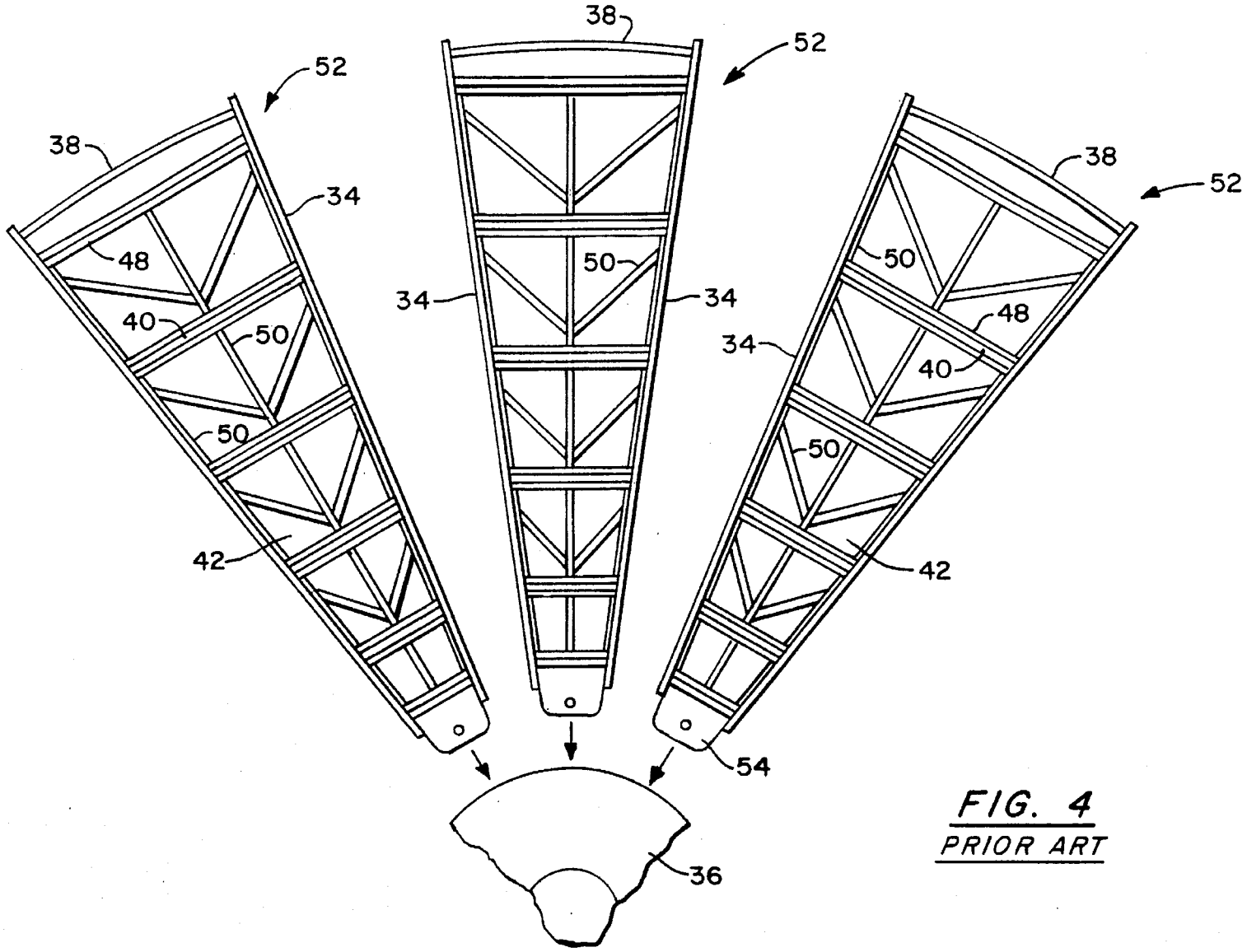
FIG. 4 PRIOR ART
FIG. 4 is an exploded view of a portion of a rotor showing three of the sector modules for a prior art modular rotor illustrating the modules arranged around the rotor shaft ready to be moved into position and attached to the shaft.

FIG. 4 of the drawings shows the other basic type of prior art air preheater rotor which is the modular, field assembled rotor. This rotor is assembled in the field, as the name implies, from the sector modules 52. Each sector module 52 is constructed much the same as the sectors of the shop-assembled rotor shown in FIG. 2. The major difference is that the resulting rotor has double layered diaphragms created by the abutting diaphragms 34 of adjacent modules. In other words, there are twice as many diaphragms as the non-modular rotor. This is costly plus the added frontal area of the double diaphragms allows for less heat transfer area for a given rotor size. The modular heat exchange baskets 22 as well as the cold-end baskets 46 are positioned and supported in these sector modules 52 the same as in the non-modular rotor as shown in FIG. 3. The modules 52 include fittings or lugs 54 on the inner ends which are adapted to be inserted into the rotor hub 36 and pinned in place.

Figure 5:
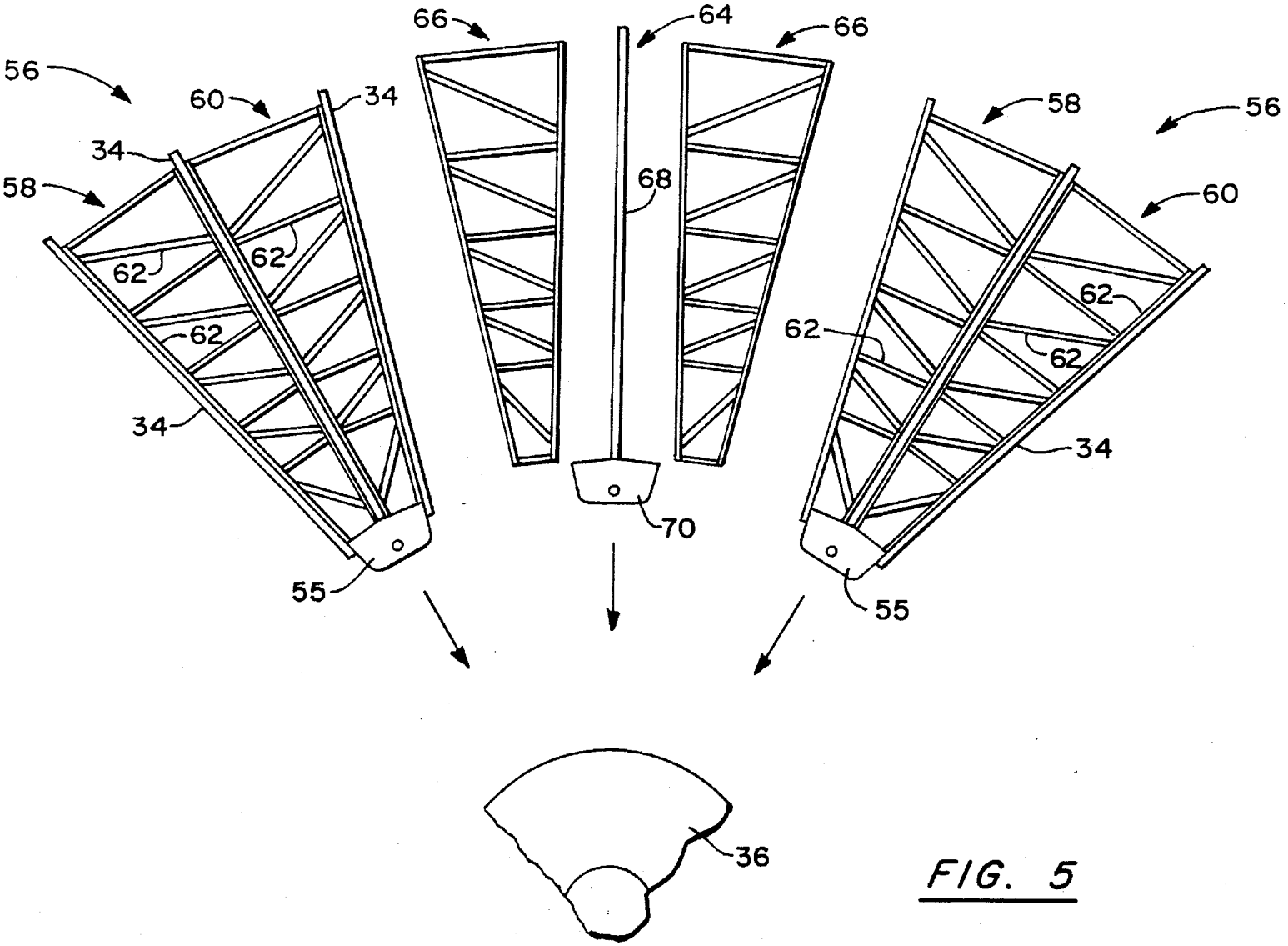
FIG. 5 is an exploded or disassembled plan view of a portion of the semi modular rotor of the present invention showing the shop assembled modules and the field installed components ready to be moved into position and attached to each other and to the rotor shaft.
Figure 6:
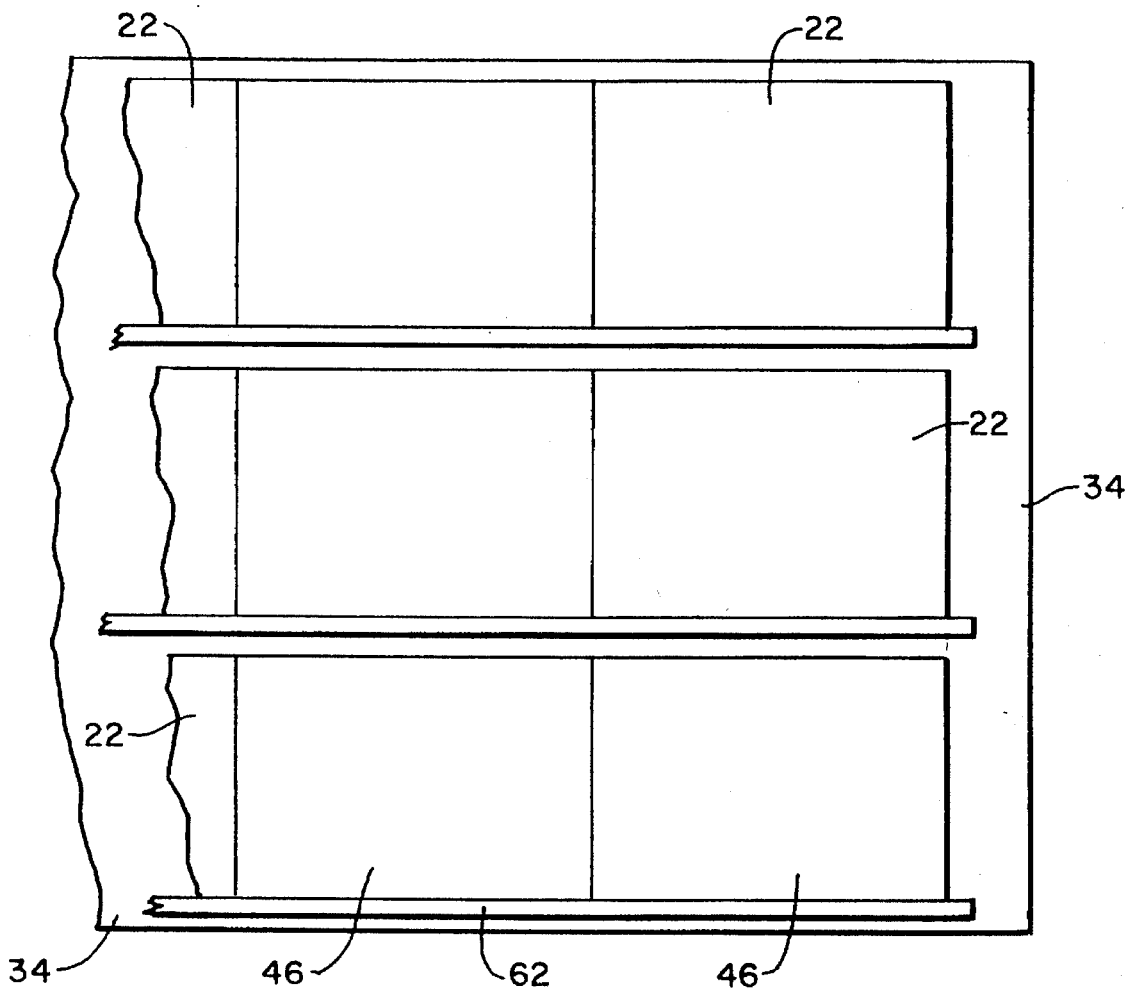
FIG. 6 is a cross section view of a portion of an assembled semi modular rotor of the present invention showing the heat exchange baskets in position.

Turning now to the present invention and to FIGS. 5 and 6, the rotor is assembled from a series of shop assembled modules 56 and a series of field assembled components which are located between the shop assembled modules and which complete the rotor construction without any double diaphragms. The shop assembled modules 56 are illustrated in this FIG. 5 as comprising three diaphragms 34 and therefore including two sectors generally designated 58 and 60. However, these shop assembled modules 56 of the present invention could be formed with only one sector or with three or more sectors depending upon the size of the rotor and other factors which dictate the desired mix of shop assembled and field assembled components. Indeed, it is possible and even desirable in some circumstances that field assembled portions of the rotor could consist only of inserting the support grating structures 66 between alternate shop assembled modules to form completed rotors. Each shop assembled module 56 comprises the diaphragms 34 and the inboard lug 55 which is similar to the lug 54 in FIG. 4 but which is larger because it is associated with the two sectors 58 and 60. Similarly module size is further affected if the field assembled portions do not include module lugs.

The shop assembled modules 56 do not contain any stay plates. Instead, the diaphragms 34 are tied together by the support gratings generally designated as 62. As can be seen in FIG. 6, these gratings 62 form supports for the basket modules 22 as well as the cold end basket modules 46. The gratings may be any desired construction and configuration as long as they are capable of providing a rigid rotor and supporting the baskets. As previously explained, the rotor of the present invention is a radially loaded rotor rather than an axially or duct loaded rotor as in FIGS. 2 and 4.

As indicated in FIG. 5, the shop assembled modules 56 are attached to the rotor shaft or hub 36 in spaced positions leaving an open space between them. The remaining components of the rotor which are then field assembled are located in these spaces. The field assembled components comprise module lug and diaphragm assembly 64 and the grating assemblies 66. The modular lug and diaphragm assembly 64 includes a diaphragm 68, which is essentially the same as each of the diaphragms 34, and the lug 70, which is essentially the same as the lugs 55. The grating assemblies 66 are essentially the same as the gratings 62 which form a part of the shop assembled modules 56. These gratings 66 are comparable to the gratings 62 of the shop assembled modules 56. These gratings 66 are attached to and between the shop assembled modules 56 and the diaphragm 68 preferably by welding to complete the rotor structure. A grating 66 is located at each basket level within the rotor the same as the gratings 62 in the shop assembled modules 56 as seen in FIG. 6. Of course, the arrangement of shop assembled modules 56 and field assembled components 64 and 66 continues all the way around the hub 36 to form a complete rotor structure. For example purposes only, a rotor with 24 sectors could have six shop assembled modules with 12 sectors (assuming two sectors per module as illustrated) and six sets of field assembled components also with 12 sectors for the total of 24 sectors.

The present invention combines the advantages of both modular and non-modular rotor structures and eliminates some of the disadvantages of each. By eliminating the double diaphragms of the modular design in conjunction with the use of support gratings and eliminating stay plates, the allowable space available for heat transfer surface is increased. Also, the use of the support gratings with the installation of the baskets through the periphery means that the baskets can be wedged into the sectors in contact with each other and with the diaphragms. This eliminates the need for gaps around the baskets, stiffens the rotor structure and further increases the available heat transfer free area and the thermal efficiency.

We claim:

1. A method of fabricating a rotor for a rotary regenerative air preheater having a rotor hub and a plurality of diaphragm plates extending radially outward from said hub dividing said rotor into a plurality of sectors for supporting modular heat transfer baskets therein comprising the steps of:

a. assembling a plurality of rotor modules each including at least one sector and comprising:
   i. radially extending diaphragm plates extending along the side of each sector,
   ii. at least one support grating mounted between said diaphragm plates in each sector adapted to support said modular heat transfer baskets thereon,
   iii. means attached to said diaphragm plates adapted to mount said rotor module on said rotor hub;

b. forming a plurality of diaphragm assemblies each including an independent radially extending diaphragm plate and means adapted to mount said independent diaphragm plate on said rotor hub;

c. forming a plurality of separate support gratings adapted to be mounted in said rotor sectors and adapted to support said modular heat transfer baskets thereon;

d. mounting said plurality of rotor modules on said rotor hub at spaced intervals;

e. mounting one of said plurality of diaphragm assemblies on said rotor hub in each of said intervals between said spaced rotor modules thereby forming sector spaces on each side of each of said diaphragm assemblies and between said diaphragm assemblies and the adjacent said rotor module adjacent rotor modules;

f. mounting at least one of said plurality of separate support gratings in each of said sector spaces between said diaphragm assemblies and said adjacent rotor module.

2. A method as recited in claim 1 wherein each rotor module includes at least two sectors.

3. A method as recited in claim 1 wherein each sector includes a plurality of support gratings.

4. A method as recited in claim 1 wherein said diaphragm assemblies are mounted in said intervals midway between said spaced rotor modules.

* * * * *

UNITED STATES PATENT AND TRADEMARK OFFICE

CERTIFICATE OF CORRECTION

PATENT NO. : 5,615,732

DATED : April 1, 1997

INVENTOR(S) : Mark E. Brophy et al

It is certified that error appears in the above-indentified patent and that said Letters Patent is hereby corrected as shown below:

Title page, at item [73], after "ABB" insert --Air--.

Signed and Sealed this

First Day of July, 1997

Bruce Lehman

*Attest:*

BRUCE LEHMAN

*Attesting Officer*

*Commissioner of Patents and Trademarks*